US007802613B2

(12) United States Patent
Bullied et al.

(10) Patent No.: US 7,802,613 B2
(45) **Date of Patent: *Sep. 28, 2010**

(54) METALLIC COATED CORES TO FACILITATE THIN WALL CASTING

(75) Inventors: Steven J. Bullied, Pomfret Center, CT (US); Joseph J. Parkos, Jr., East Haddam, CT (US); Joshua E. Persky, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/343,369

(22) Filed: Jan. 30, 2006

(65) Prior Publication Data

US 2010/0219325 A1 Sep. 2, 2010

(51) Int. Cl.
*B22C 9/10* (2006.01)

(52) U.S. Cl. ..... 164/369

(58) Field of Classification Search ..... 164/369, 164/361

See application file for complete search history.

(56) References Cited

U.S. PATENT DOCUMENTS 3,824,113 A * 7/1974 Loxley et al. ..... 427/431
4,167,418 A * 9/1979 Svirsky et al. ..... 106/38.28
5,738,819 A * 4/1998 Feagin ..... 264/635
6,637,500 B2 * 10/2003 Shah et al. ..... 164/369
7,036,556 B2 * 5/2006 Caputo et al. ..... 164/369
7,201,212 B2 4/2007 Bullied et al.
2005/0189086 A1 * 9/2005 Caputo et al. ..... 164/361
2007/0116972 A1 * 5/2007 Persky ..... 428/457

OTHER PUBLICATIONS

David R. Lide, Ph.D., CRC Handbook of Chemistry and Physics, 1990-1991, p. 1-10, CRC Press, Inc.
European Search Report, Apr. 27, 2007.

* cited by examiner

*Primary Examiner*—Kevin P Kerns
(74) *Attorney, Agent, or Firm*—Bachman & LaPointe, P.C.

(57) ABSTRACT

A core for investment casting processes includes a core having one or more ceramic materials; and an exterior layer of metal material not susceptible to oxidation under investment casting operating conditions. A method for casting a turbine engine component having an internal passageway includes the steps of forming one or more mold sections each having internal surfaces and at least one of the aforementioned cores for forming one or more turbine engine components having at least one internal passageway; assembling the one or more mold sections; introducing a molten alloy into the one or more assembled mold sections; and consuming the metal of the at least one core during the process.

4 Claims, 2 Drawing Sheets

METALLIC COATED CORES TO FACILITATE THIN WALL CASTING

FIELD OF USE

The present disclosure relates to investment casting and, more particularly, relates to thin wall casting.

BACKGROUND OF THE INVENTION

Investment casting is a commonly used technique for forming metallic components having complex geometries, especially hollow components, and is used in the fabrication of superalloy gas turbine engine components such as blades and vanes and their hollow airfoils.

Advanced airfoil designs have very thin metal walls and complex cooling passages. Depending upon the size of the features to be cast, these cooling passages are formed either with ceramic mini-cores and/or refractory metal cores. The combined features make the cooling passages extremely difficult to cast successfully due to the high surface area of ceramic in relation to the amount of metal in the thin wall areas. Ceramic to molten metal contact has a high surface tension associated with such contact. The ceramic does not 'wet out' easily leading to non-fill defects.

Consequently, there exists room for improvements in the investment casting process.

SUMMARY OF THE INVENTION

In accordance with the present disclosure, a core for investment casting processes broadly comprises a core comprising one or more ceramic materials, one or more refractory metal cores, or both said ceramic materials and said refractory metal cores; and an exterior layer of a metal compatible with a casting material.

In accordance with another aspect of the present disclosure, a method for casting a turbine engine component having an internal passageway comprises forming one or more mold sections each having internal surfaces and at least one core comprising a layer of a metal compatible with a casting material for forming one or more turbine engine components having at least one internal passageway; assembling the one or more mold sections; introducing a molten alloy into the one or more assembled mold sections; and consuming the layer of the metal of the at least one core.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

The present article(s) and method(s) described herein are intended to facilitate the casting of complex structural features while reducing part defects associated with the failure to "wet out" due to surface tension between ceramic to molten metal contact. The present method involves coating ceramic cores and refractory metal cores with a metal containing material prior to the wax injection operation of the investment casting process. The metal coating prevents the ceramic to molten metal contact during the process, and instead provides a metal to metal contact to which a much lower surface tension is associated than ceramic to molten metal contact. The lower surface tension facilitates the filling of the thin wall features, e.g., complex cooling passages, and reduces part variations and defects.

Figure 1:
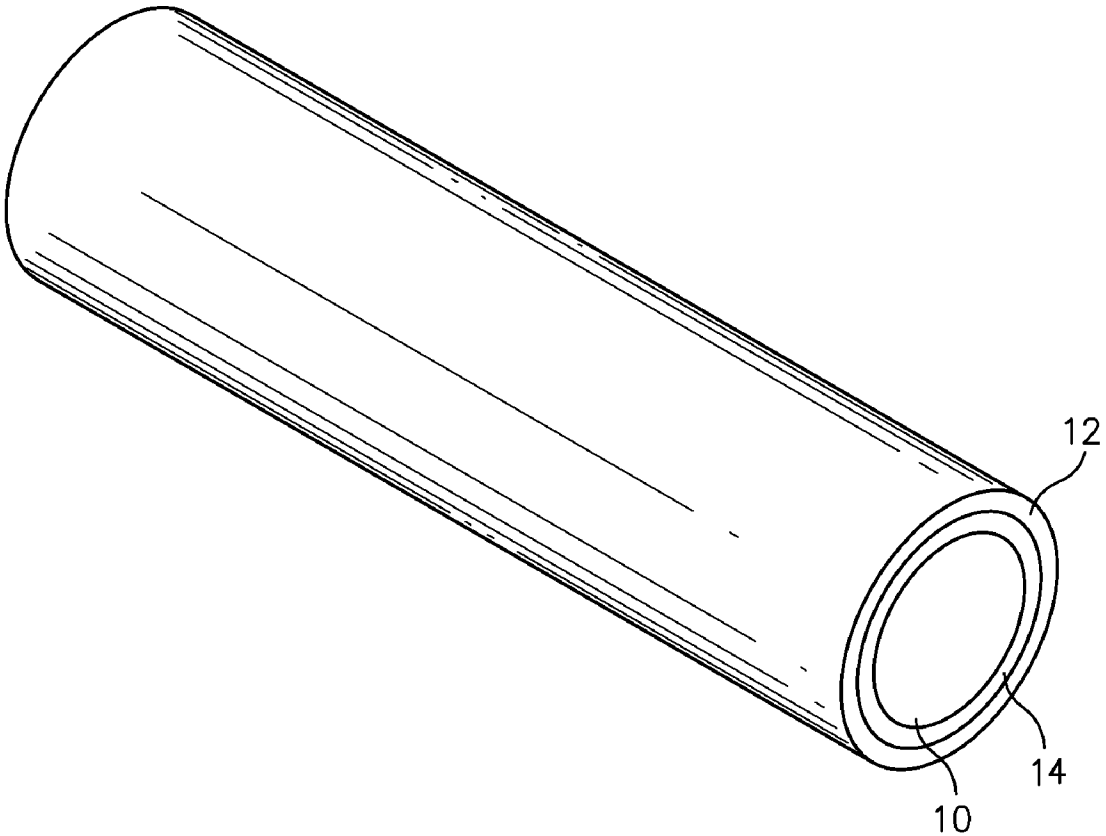
FIG. 1 is a representation of a metal coated core of the present invention.

Referring now to FIG. 1, a core 10 for use in investment casting processes is shown. Core 10 generally comprises a substantially cylindrical shape composed of one or more ceramic materials known to one of ordinary skill in the art, one or more refractory metal core ("RMC") materials known to one of ordinary skill in the art, and combinations of both ceramic and RMC materials. For example, the ceramic materials may include, but are not limited to, silica based, alumina based, mixtures comprising at least one of the foregoing ceramic materials, and the like. The RMC materials may include, but are not limited to, molybdenum, niobium, tantalum, tungsten, and the like. As known to one of ordinary skill in the art, such RMC materials may include a protective ceramic coating such as silica, alumina, zirconia, chromia, mullite and hafnia to prevent oxidation and erosion by molten metal.

An exterior layer 12 comprising a metal material may be disposed about the exterior surface of the core 10. The exterior layer may be along the ceramic of a ceramic core or of the protective coating on an RMC as is discussed further below. In the particular illustrated example, the core 10 is an RMC with a protective ceramic coating 14 between the core 10 and the exterior layer 12. The metal material generally comprises a metal not susceptible to oxidation under investment casting operating conditions. For example, the metal material of the exterior layer 12 may comprise a noble metal such as, but not limited to, gold, platinum and combinations comprising at least one of the foregoing noble metals. Preferably, the metal selected is compatible with the molten metal being cast to form the molded part.

The exterior layer 12 generally possesses a thickness sufficient to provide the desired metal to metal contact as known to one of ordinary skill in the art. The metal of the exterior layer 12 may be applied by any one of a number of deposition techniques known to one of ordinary skill in the art. For example, the metal may be sputtered onto core 10 to form the exterior layer 12 using any number of sputtering techniques known to one of ordinary skill in the art. Or, in another example, the metal may be plated onto core 10 to form the exterior layer 12 using any number of plating techniques known to one of ordinary skill in the art. As known to one of ordinary skill in the art, sputtering techniques produce a very thin layer, for example, ten-thousandths of an inch to hundred-thousandths of an inch in thickness. And, plating techniques are also capable of producing a layer of comparable thickness. As described, the metal compatible with a casting material may comprise a noble metal and/or a metal selected from Group VIII, Group VIIIA and Group IB of the Periodic Table of Elements as shown in the Handbook of Chemistry and Physics, CRC Press, 71$^{st}$ ed., p. 1-10 (1990-91). It is also contemplated that additional metals may be employed when an inert atmosphere, such as a noble gas, is utilized when applying the exterior layer 12 to the core 10.

As described above, the exterior layer 12 of metal material prevents ceramic to molten metal contact during the investment casting process, and instead provides a metal to metal contact with which a much lower surface tension is associated. The lower surface tension facilitates the filling of the thin wall features, e.g., complex cooling passages, and reduces part variations and defects.

Figure 2:
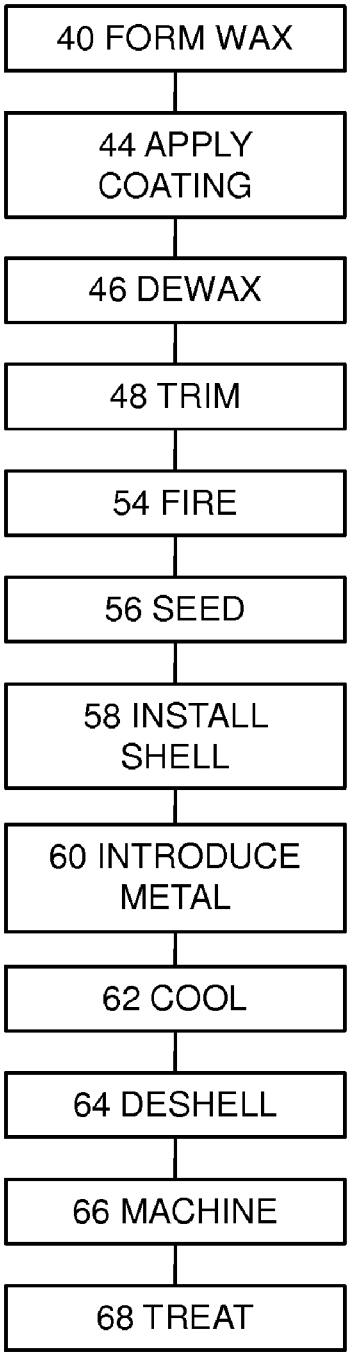
FIG. 2 is a representation of an investment casting process employing the metal coated cores of FIG. 1.

The metal coated cores 10 may be utilized in any investment casting process known to one of ordinary skill in the art. More particularly, the metal coated cores 10 may be utilized whenever parts having hollow interiors are being cast. For purposes of illustration, and not to be taken in a limiting sense, FIG. 2 shows an exemplary sequence of steps for using the metal coated cores 10 described herein in an investment casting process. A wax pattern is formed 40 over the core(s).

A shell-forming coating may be applied 44 in one or more steps involving combinations of wet or dry dipping and wet or dry spraying.

After a final drying, the wax may be removed via a dewax process 46 such as in a steam autoclave. After the dewax process, the shell may then be trimmed 48 and minor defects in the shell may be patched. The shell may be fired 54 to strengthen the shell and may be seeded 56 if required to form a predetermined crystallographic orientation. The shell may then be installed 58 in the casting furnace and the molten metal introduced 60. The molten metal consumes the exterior metal material layer 12 of metal coated core 10 which simultaneously facilitates the intended metal to metal contact and desired reduced surface tension. After cooling 62 of the metal, the metal part(s) may be deshelled 64. Machining 66 may separate the parts from each other, remove additional surplus material, and provide desired external and internal part profiles. Post machining treatments 68 may include heat or chemical treatments, coatings, or the like.

The metal coated cores and method(s) utilizing said cores described herein provides a significant advantage over non-metal coated cores and their methods of use of the prior art. The metal coating described herein prevents the ceramic to molten metal contact during the investment casting process, and instead provides a metal to metal contact to which a much lower surface tension is associated. The lower surface tension facilitates the filling of the thin wall features, e.g., complex cooling passages, and reduces part variations and defects. By employing metal coated cores in investment casting processes, thin walled, hollow parts having complex features may be cast consistently with such results being reproducible.

It is to be understood that the invention is not limited to the illustrations described and shown herein, which are deemed to be merely illustrative of the best modes of carrying out the invention, and which are susceptible to modification of form, size, arrangement of parts, and details of operation. The invention rather is intended to encompass all such modifications which are within its spirit and scope as defined by the claims.

What is claimed is:

1. A core for investment casting processes, comprising:

a core comprising a combination of one or more ceramic materials selected from the group consisting of silica based ceramic materials, alumina based ceramic materials and combinations thereof, and one or more refractory metal core materials selected from the group consisting of molybdenum, niobium, tantalum and tungsten; and an exterior layer of a metal compatible with a casting material deposited upon an exterior surface of said core, said metal comprising a noble metal, wherein:

the exterior layer is on the one or more ceramic materials; and said core includes a protective coating disposed between said exterior surface and said exterior layer, said protective coating is selected from the group consisting of silica, alumina, zirconia, chromia, mullite and hafnia.

2. The core of claim 1, wherein said metal comprises a metal selected from the group consisting of Group VIII, Group VIIIA and Group M.

3. The core of claim 1, wherein said exterior layer of said metal is a layer of sputtered metal material.

4. The core of claim 1, wherein said layer of said metal is a layer of plated metal material.

* * * * *